US005893183A

United States Patent [19]

Bechtold, Jr.

[11] Patent Number: 5,893,183

[45] Date of Patent: Apr. 13, 1999

[54] DUAL CUSHION BODY SUPPORT SYSTEM

[76] Inventor: Joseph A. Bechtold, Jr., 3890 Salisbury Rd., South Euclid, Ohio 44121

[21] Appl. No.: 08/994,068

[22] Filed: Dec. 19, 1997

Related U.S. Application Data

[60] Provisional application No. 60/034,105, Dec. 30, 1996.

[51] Int. Cl.[6] ..... A47C 27/18; A47C 27/10

[52] U.S. Cl. ..... 5/632; 5/725; 128/845

[58] Field of Search ..... 5/632, 630, 638, 5/644, 646, 648, 690, 706, 710, 725, 420, 655.3; 606/240, 242; 128/845

[56] References Cited

U.S. PATENT DOCUMENTS

| | | | |
|---|---|---|---|
| D. 155,924 | 11/1949 | Ray | D6/601 |
| D. 203,962 | 3/1966 | Taylor | D6/592 |
| D. 232,588 | 8/1974 | Radford | D24/183 |
| 1,710,400 | 4/1929 | Bebout | 606/242 |
| 1,764,756 | 6/1930 | Slee | 5/419 |
| 1,764,757 | 6/1930 | Slee | 5/419 |
| 1,981,666 | 11/1934 | Ridley | 5/632 |
| 2,461,434 | 2/1949 | Moyers | 5/71 |
| 3,366,106 | 1/1968 | Yao et al. | 5/638 |
| 3,644,949 | 2/1972 | Diamond | 5/644 |
| 3,900,910 | 8/1975 | Nakata | 5/644 |
| 3,949,437 | 4/1976 | Gritsch | 5/338 |
| 4,398,707 | 8/1983 | Cloward | 5/621 |
| 4,428,087 | 1/1984 | Horn | 5/638 |
| 4,473,913 | 10/1984 | Ylvisaker | 5/632 |
| 4,528,705 | 7/1985 | Greenawalt | 5/644 |
| 4,639,960 | 2/1987 | Quillen et al. | 5/632 |
| 4,780,921 | 11/1988 | Lahn et al. | 5/644 |
| 5,044,026 | 9/1991 | Matthews | 5/435 |
| 5,054,142 | 10/1991 | Owens | 5/431 |
| 5,095,569 | 3/1992 | Glenn | 5/490 |
| 5,412,824 | 5/1995 | Emerson et al. | 5/632 |
| 5,632,050 | 5/1997 | Zajas et al. | 5/632 |
| 5,644,807 | 7/1997 | Battistella | 5/419 |

OTHER PUBLICATIONS

Body Support System, Inc. "Body Cushion" 2–page Advertisement at pp. 130–131 *Massage* Magazine, Issue #64, Nov./Dec. 1966.

M.A.T. Massage System "Hands–on Relief" 1–page Advertisement *Pyramid Collection* Catalogs, Winter/Spring 1998.

*Primary Examiner*—Alex Grosz

*Attorney, Agent, or Firm*—David A. Burge

[57] ABSTRACT

A dual cushion body support system includes a relatively thin, elongate, substantially flat, top cushion and a relatively shorter base cushion that is configured to underlie and elevate a central part of the top cushion to provide upwardly arched support to a person lying in a prone, face down position to comfortably elevate the upper back and shoulders of the person for gently stretching, positioning and exposing muscles of the neck and back for treatment such as massage. The top cushion serves as flexible pad and as a protective cover that drapes the underlying base cushion and relies on the base cushion to provide a properly arched body support contour. An end portion of the top cushion that drapes beyond the length of the base cushion is provided with an upstanding forehead support formation to assist in comfortably supporting the person's head; and, the top cushion is sufficiently flexible to permit its being rolled up for ease of transport and for compact storage. The base cushion is inflatable and preferably employs separately inflatable chambers to provide ready adjustment of the contour and effective length of the base cushion; and, the base cushion can be deflated for ease of transport and compact storage.

10 Claims, 4 Drawing Sheets

DUAL CUSHION BODY SUPPORT SYSTEM

REFERENCE TO PROVISIONAL APPLICATION

This application claims the benefit of U.S. Provisional Application Ser. No. 60/034,105 entitled CONTOURED CUSHION BODY SUPPORT SYSTEM filed Dec. 30, 1996, now abandoned by Joseph A. Bechtold, Jr., the disclosure of which is incorporated herein by reference.

CROSS-REFERENCE TO RELATED APPLICATION

Reference also is made to a companion design application filed on Dec. 19, 1997, as 29/080,925, by Joseph A. Bechtold, Jr. entitled RESILIENT SUPPORT CUSHION FOR BODY MASSAGE, the disclosure of which is incorporated herein by reference.

BACKGROUND OF THE INVENTION

1. Field of the Invention

The present invention relates generally to a dual cushion body support system for providing upwardly arched body support to a person lying in a prone, face down position to comfortably elevate the upper back and shoulders of the person for gently stretching, positioning and exposing muscles of the neck and back for massage or other treatment. More particularly, the present invention relates to a dual cushion body support 1) that utilizes a relatively thin, elongate, substantially flat top cushion which serves as a flexible pad and as a protective cover, and 2) that relies on a relatively shorter base cushion to underlie and elevate a central part of the top cushion to provide a support of properly arched contour—wherein the top cushion is quite flexible and can be rolled up for storage, wherein the base cushion is inflatable and can be deflated for storage, and wherein the base cushion preferably includes separately inflatable chambers to provide for adjustment of its contour and effective length.

2. Prior Art

Cushioned body support apparatus for underlying and supporting the human body, for example during the administration of medical or therapeutic procedures such as massage, are known, an example being a multi-component contoured cushion that is described in U.S. Pat. No. 5,054,142 issued Oct. 8, 1991 to Thomas P. Owens. Like many other proposals, the Owens apparatus comprises a complex and relatively expensive set of support components that is not well suited for home use—a set of components that typically requires manual adjustment and careful repositioning when used with persons of different heights—a set of support components that is most effectively put to use by a trained professional.

While a variety of other forms of body support apparatus have been proposed for use in treatment and therapy, a long-standing need has gone unsatisfied for a simple, thoughtfully designed body support system that is well suited for home use as an aid in the effective administration of muscle relaxing treatment such as massage—a body support system which includes a minimal number of components that can be used atop a bed or a carpeted floor, that are capable of providing an arched support of adjustable length and contour for use with persons of differing height, that is light in weight and easy to transport, and that can be compactly stored.

SUMMARY OF THE INVENTION

The present invention addresses the foregoing and other needs and drawbacks of prior proposals by providing a dual cushion system for providing upwardly arched body support to a person lying prone, facing downwardly, to comfortably elevate the upper back and shoulders of the person to gently stretch, position and expose muscles of the neck and back for treatment such as massage—a body support system that makes advantageous use of two very different types of cushions one of which can be rolled up and the other of which can be deflated for ease of transport and for compact storage—a two cushion body support that can be quickly and easily set up in a home environment for correct use by untrained personnel—a dual cushion support 1) that utilizes a relatively thin, elongate, substantially flat top cushion which serves as a flexible pad and as a protective cover, and 2) that relies on a relatively shorter base cushion to underlie and elevate a central part of the top cushion to provide a support of properly upwardly arched contour—a dual cushion body support system having an upwardly arched contour that can be adjusted by controlling the inflation of the base cushion, with the effective length of the base cushion also preferably being adjustable through the use of separately inflatable chambers provided in the base cushion.

What the system of the present invention recognizes is that significant economy and simplicity can be achieved through the use of a two component system wherein the task of providing a properly configured and contoured upper torso support is delegated to an inflatable base cushion that preferably utilizes a plurality of separately inflatable chambers to permit its contour and effective length to be easily adjusted, and wherein the task of providing pad-like resilient support and a protective cover is delegated to a simply configured top cushion that drapes the base cushion and has sufficient flexibility to conform to a variety of base cushion contours and lengths—whereby quite an effective body support system is provided at relatively low cost that is quite well suited for home use that requires only two relatively lightweight, uncomplicated components that are easy to transport, require no training for proper use, and that can be compactly stored.

Whereas many prior proposals have called for the use of plurality of specially contoured body positioning components that each are complexly configured, the present invention recognizes that the basic underlying support needed for back, shoulder and neck massage and the like can be provided by a single base cushion of proper contour—and that the remaining requirements of a home massage body support system can be met by providing a relatively thin, resilient, pad-like top cushion which cooperates with the base cushion to enhance the upwardly arched support contour provided by the dual cushions, with the top cushion also serving as something of a protective cover to prevent such fluids as body oil employed during massage from falling or spilling onto underlying bed clothes or carpeted floor surfaces.

Whereas prior proposals have provided components of equal durability and service longevity that are intended to be used in combination in one given way, the system of the present invention preferably utilizes a relatively inexpensively formed, elongate, pad-like protective cover that can be replaced at relatively little cost when worn or soiled, and that can be used with an adjustably configured inflatable base cushion that preferably has a plurality of separately inflatable chambers that permit the configuration of the base cushion to be modified, for example to shorten its length for use with shorter persons, and to lengthen it for use with taller persons. In preferred practice, the majority of the cost of the dual cushion support system is invested in the contoured base cushion component which is what is principally relied on for upper torso support, with the very flexible top cushion configuring itself to the contour provided by the base cushion and having portions that drape beyond the base cushion to extend the support contour to locations that underlie the head, arms and lower body portions of a person who is supported atop the dual cushion set in a prone, face down position.

In preferred practice, the top cushion is cut from a sheet of resilient foam material having a thickness of about one-half inch to about one inch, and is protectively coated to provide a resilient outer skin that can be wiped clean with water and mild detergent—a structure that normally will not absorb body oils used during massage, perspiration and the like. In preferred practice, the elongate top cushion has a upper-body-support region at one end thereof, and a lower-body-support region at the other end thereof—with a central part of the top cushion being defined about the juncture of these two end regions, and with a raised, upstanding forehead support formation being provided on the upper-body-support region to assist sizable portions of the upper-body-support region that drape beyond the length of the underlying base cushion in supporting one's head and arms. In preferred practice, a face opening is formed through the upper-body-support region adjacent the forehead support formation to ensure that the upper-body-support region does not come needlessly in contact with face of a person who lies prone, facing downwardly atop the top cushion—and so that the supported person will not have a "confined" feeling when lying face down atop the top cushion.

In preferred practice, the base cushion is formed from a flexible material such as vinyl fabric that has been configured to define a cushion of generally wedge-shaped contour for elevating one's upper back and shoulders to a greater height than other portions of one's torso. Two separately inflatable compartments preferably are defined within the base cushion so that, when the base cushion is used to support a relatively short person, only one of the two compartments needs to be inflated to give the base cushion a relatively short length, and both compartments can be inflated to give the base cushion a longer length for use in supporting the more lengthy torso of a taller person for gently stretching, positioning and exposing for massage or other treatment the muscles of the neck and back.

BRIEF DESCRIPTION OF THE DRAWINGS

These and other features, and a fuller understanding of the present invention may be had by referring to the following description and claims, taken in conjunction with the accompanying drawings, wherein:

DESCRIPTION OF THE PREFERRED EMBODIMENT

Figure 1:
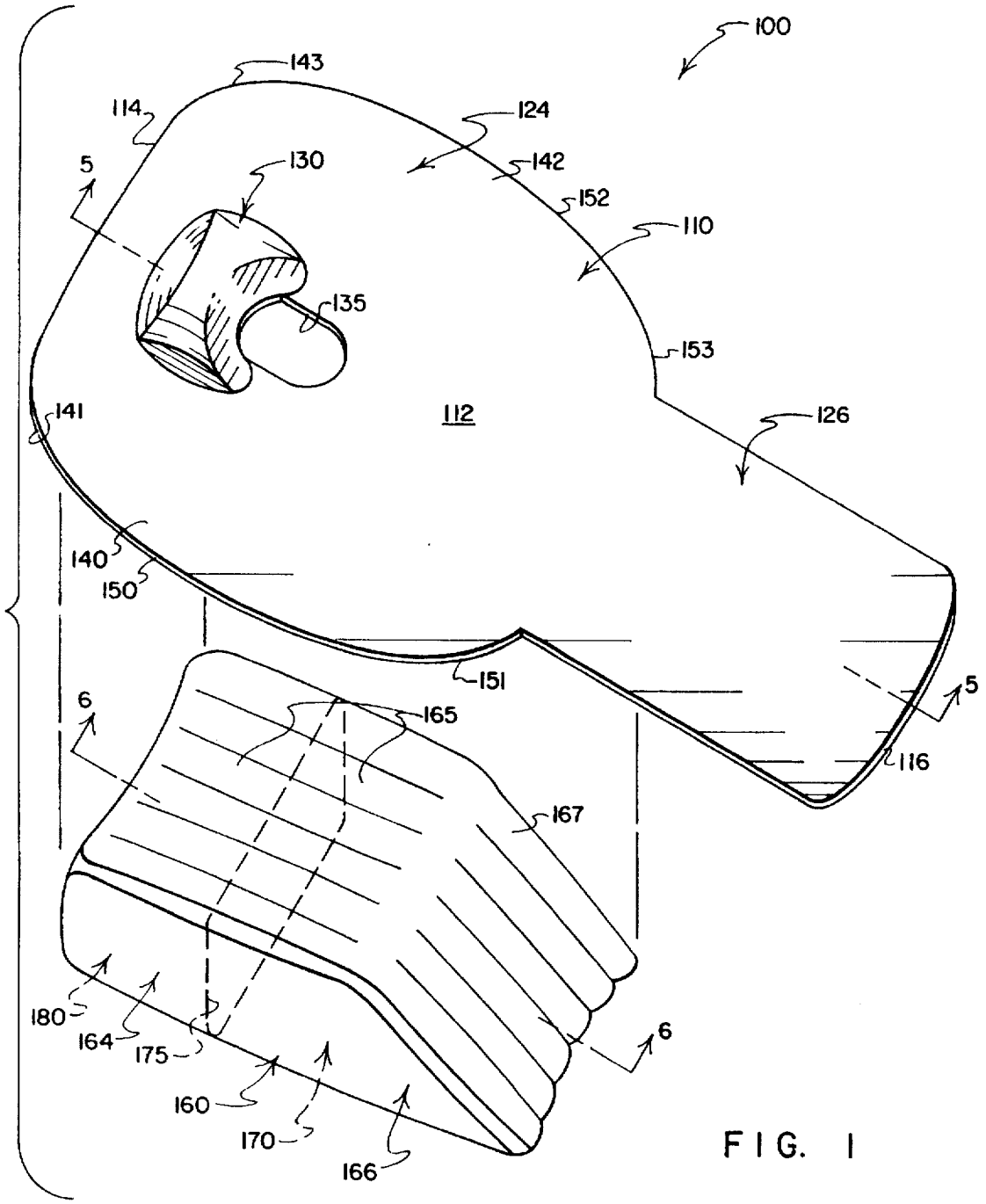
FIG. 1 is an exploded perspective view of top and base cushions of a dual cushion type body support system embodying one preferred form of the present invention, with the location of a hidden wall that divides the interior of the base cushion into two separately inflatable chambers being indicated by dotted lines.

Referring to FIG. 1, a dual cushion body support system embodying one form of preferred practice of the present invention is indicated generally by the numeral 100. The support system 100 (also referred to herein as a "dual cushion support") includes an elongate, flexible top cushion 110 and an elongate but relatively shorter base cushion 160 for underlying a central part 112 of the top cushion 110 for supporting the body of a person in a prone, face down position to gently stretch, position and expose muscles of the neck and back for administration of treatment such as massage.

Figure 2:
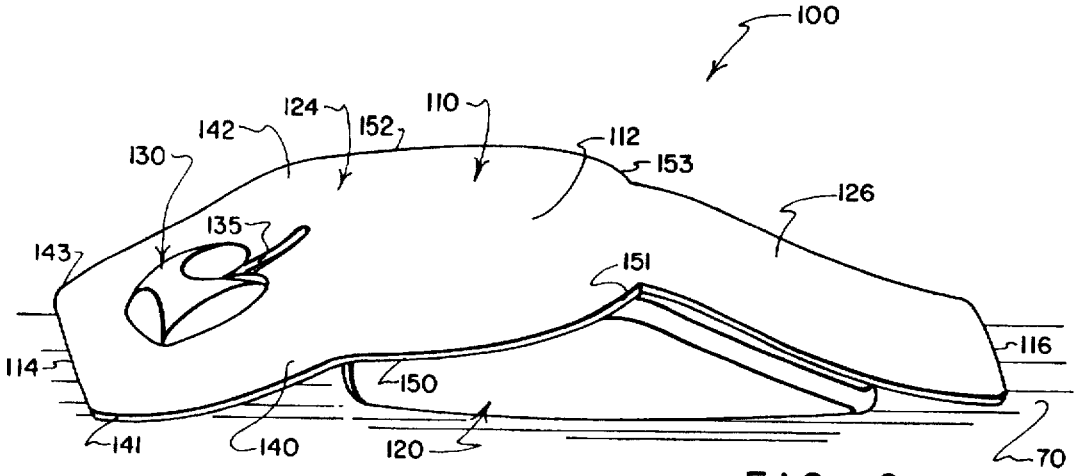
FIG. 2 is a side elevational view thereof with the top cushion overlying the base cushion, with both of the chambers of the base cushion inflated.
Figure 3:
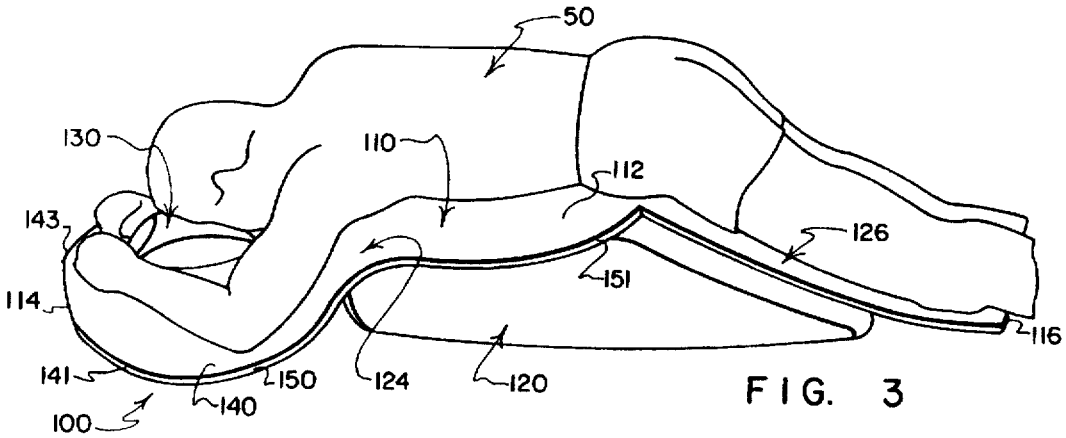
FIG. 3 is a side elevational view similar to FIG. 2 showing the dual cushion system supporting and positioning the body of a relatively tall person, with both of the chambers of base cushion inflated.

In overview, the dual cushion support 100 is readied for use (as is depicted in FIG. 2) by positioning the base cushion 160 on a generally horizontal support surface 70, and by draping the top cushion 110 lengthwise over the base cushion 160 so that the central part 112 of the top cushion 110 is caused to arch upwardly while opposite upper and lower ends 114, 116 of the top cushion 110 extend beyond the length of the base cushion 160 and drape downwardly toward and typically into engagement with the support surface 70. Illustrated in FIG. 3 is the manner in which the body of a relatively tall person 50 preferably is supported and positioned atop the dual cushion system 100 for treatment such as massage. Illustrated in FIG. 4 is the manner in which the body of a relatively shorter person 60 is supported and positioned atop the dual cushion system 100 for treatment such as massage.

Figure 4:
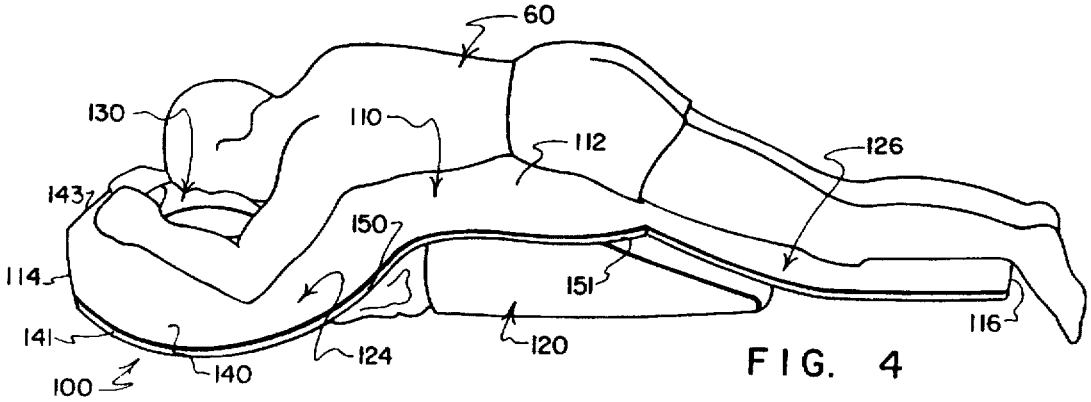
FIG. 4 is a side elevational view similar to FIG. 2 showing the dual cushion system supporting and positioning the body of a relatively shorter person, with only a main chamber of the base cushion inflated thereby effectively shortening the length of the base cushion.

The configuration of the dual cushion support 100 as illustrated in FIGS. 3 and 4 differs due to a difference in the manner and extent to which the base cushion 160 is inflated: in FIG. 3, the base cushion 160 has been inflated to a greater extent and has a longer effective length than in FIG. 4. As will be explained in greater detail shortly, a feature of the preferred practice of the present invention resides in a capability to modify the extent and nature of the inflation of the base cushion 160 to adjust the configuration and character of the arched support that is provided by the dual cushion system 100.

Referring to FIGS. 1 and 2, the top cushion 110 is a thin, resilient, elongate member that has a relatively wide upper-body-support region 124 which extends from the upper end 114 toward the lower end 116, and a relatively more narrow lower-body-support region 126 which extends from the lower end 116 toward the upper end 114. The central part 112 of the top cushion 110 includes significant portions of the top cushion 110 that reside within the general vicinity of the junction of the regions 124, 126.

Figure 5:
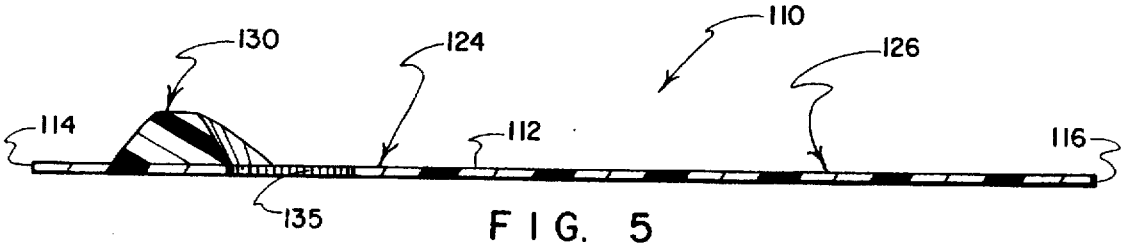
FIG. 5 is a sectional view of the top cushion seen from a plane by a line 5—5 in FIG. 1.

Referring to FIGS. 1, 2 and 5, the top cushion has an upstanding forehead support formation 130 that is connected to the upper-body-support region 124 at a location spaced a short distance from the upper end 114. The forehead support 130 is a resilient structure that extends transversely and has a pillow-shaped form. As is depicted in FIGS. 3 and 4, the forehead support 130 is engaged by the forehead of a person 50, 60 supported atop the dual cushion support 100 to aid in comfortably positioning the person's head in a downwardly tilted inclination that assists in stretching, positioning and exposing the muscles of the neck and back for treatment such as massage.

Also defined by the upper-body-support region 124 is a face opening 135 which is located farther from the upper end 114 than is the forehead support 130. The opening 135 is configured to minimize the need for the face of a person 50, 60 positioned atop the dual cushion support 100 (as depicted in FIGS. 3 and 4) to press against the top cushion 110—and also serves to minimize the onset of an uncomfortable "confined" feeling that some persons can experience in the presence of such facial contact.

Also defined by the upper-body-support region 124 are a pair of opposed side formations 140, 142 that extend to the left and right to underlie and support left and right arms of a person 50, 60 positioned atop the dual cushion support 110. In the top cushion embodiment 110 (the configuration of which is best seen in FIG. 1), the left and right side formations 140, 142 are bordered by edge surfaces 150, 152 that curve at their upper ends 141, 143 to join smoothly with the upper end 114, and that curve toward each other as their lower ends 151, 153 reach a juncture with the lower-body-support region 126.

Figure 7:
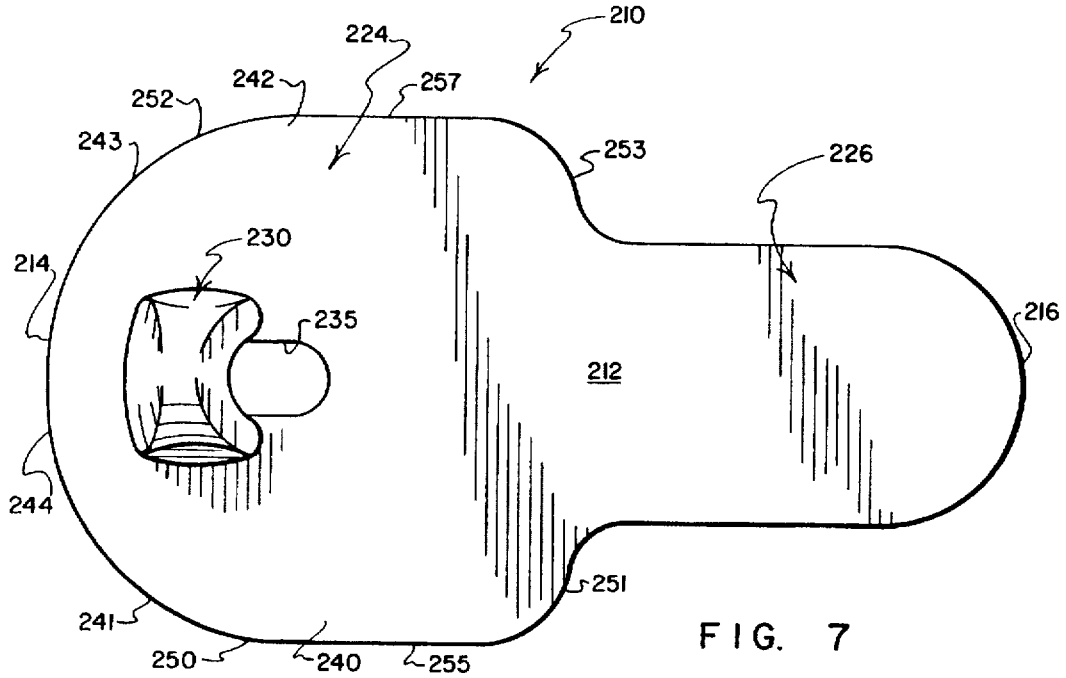
Figure 8:
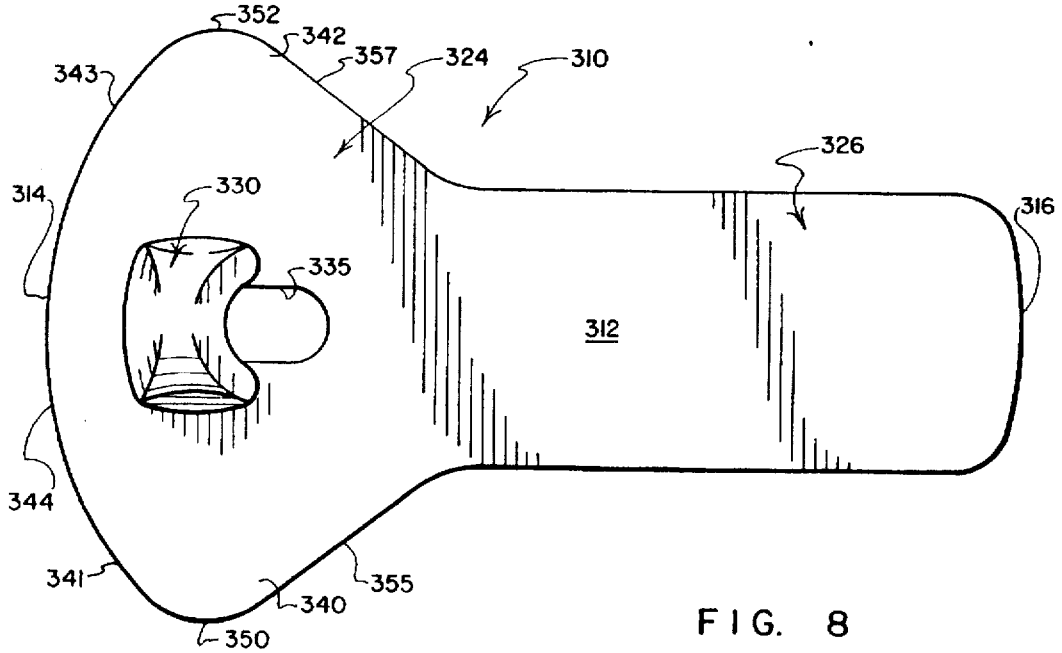

Alternate top cushion embodiments 210, 310 are illustrated in FIGS. 7 and 8. The top cushions 210, 310 are identical in all respects to the top cushion 110 (and actually have exactly the same cross-sectional configurations as the cross-section of the top cushion 110 that is illustrated in FIG. 5) except for: 1) the shape of the left and right side formations 240, 242 and 340, 342 that give different configurations to the upper-body-support regions 224, 324, respectively; and, 2) the extent to which the upper and lower ends 114, 116 and 214, 216 and 314, 316 are curved or "rounded." Thus, identical forehead support formations are indicated by the numerals 130, 230, 330, and identical face openings are indicated by the numerals 135, 235, 335.

Referring to FIG. 7, the left and right side formations 240, 242 of the top cushion embodiment 210 are bordered by edge surfaces 250, 252 that have upper end regions 241, 243 that are extensions of a large-radius arc 244 that defines the upper end 214 of the top cushion 210. Lower end regions of the edge surfaces 241, 243 define S-curve formations 251, 253 that join with the lower-body-support region 226 of the top cushion 210. Extending between the upper end regions 241, 243 and the S-curved lower end regions 251, 253 are relatively straight edge portions 255, 257 that substantially parallel the length of the top cushion 210.

Referring to FIG. 8, the left and right side formations 340, 342 of the top cushion embodiment 310 are bordered by edge surfaces 350, 352 that have upper end regions 341, 343 that are extensions of a large-radius arc 344 that defines the upper end 314 of the top cushion 310. The edge surfaces 350, 352 also have straight portions 355, 357 that are oppositely inclined to narrow the width of the upper-body-support region 324 as the upper-body-support region 324 approaches the lower-body-support region 326 of the top cushion 310.

Figure 6:
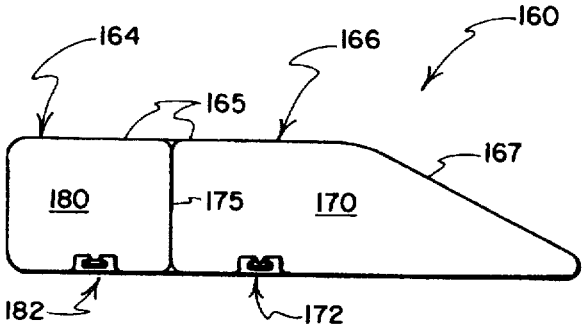
FIG. 6 isle sectional view of the base cushion seen from a plane indicated by a line 6—6 in FIG. 1; and, FIGS. 7 and 8 are top plan views illustrating alternate configurations for the top cushion that embody other preferred forms of the invention.

Referring to FIGS. 1 and 6, the base cushion 160 has a length significantly less than that of the top cushion 110 and has opposite upper and lower end regions 164, 166. The upper end region 164 defines a relatively thick chest support area 165 for underlying and significantly elevating the top cushion 110 to raise the chest and shoulders of a person lying atop the dual cushion support 100. The lower end region 166 defines a lower body support area 167 that diminishes in thickness as it extends away from the chest support area 165 to progressively diminish the height to which the lower body portions of the person are elevated by the dual cushion support 100—as is depicted in FIGS. 3 and 4.

The base cushion 160 is inflatable. In preferred practice, at least two separately inflatable chambers are defined within the base cushion, as indicated by the numerals 170, 180 in FIGS. 1 and 6. While a single separator wall 175 is depicted as dividing the interior of the base cushion 160 into the two separately inflatable chambers 170, 180, it will be understood that the interior of the base cushion 160 can be divided into a differently configured set of chambers (not shown) that are separately inflatable, or into a multiplicity of separately inflatable chambers (also not shown) as may be desired to permit the base cushion 160 to be controllably inflated to provide a desired type of under-support for the top cushion 110.

Referring to FIG. 6, recessed inflation valves 172, 182 are provided at central locations along the bottom of the base cushion 170 to permit pressurized gas such as compressed air to be admitted to, retained within and released from the chambers 170, 180, respectively. Inflation valves of this type are well known for use on air mattresses and the like, and need not be described in greater detail.

A feature of the end-to-end lengthwise arrangement of the inflatable chambers 170, 180 resides in the capability that they give the base cushion to have its effective length modified. In FIG. 3, the effective length of the base cushion 160 is maximized by fully inflating both of the chambers 170, 180. In FIG. 4, the effective length of the base cushion 160 is significantly diminished by inflating only the principal chamber 170—it being seen that the extension chamber 180 is deflated and does little, if anything, to contribute to elevation of the central part 112 of the top cushion 110.

Inflation of the extension chamber 180 to a less than full extent (not shown) will have the effect of modifying the upwardly arched curvature of the top cushion 110 just as full inflation and full deflation of the extension chamber 180 also serve to modify the upwardly arched curvature of the top cushion 110. Likewise, if the base cushion 160 is provided with other separately inflatable chambers (not shown), the configuration and character of the upwardly arched support provided by the dual cushion system 100 can be further modified.

For purposes of compact storage and ease of transport, the top cushion 110 can be rolled up and tied to form a relatively small diameter tubular bundle; and, the base cushion 160 can be fully inflated and folded—or it can be tucked into the interior of the tubular coil defined by the top cushion 110—an arrangement that does not need to be depicted to be readily understood.

In preferred practice, the top cushion 110 is formed from a resilient, foamed plastics material—and preferably is cut from a sheet of such material, with the forehead support 130 being separately formed from a block or molding of the same or similar material and adhered in place. The top cushion 110 (including the forehead support 130) is preferably protectively coated to facilitate its being wiped clean with a damp cloth, and to resist penetration by body oil used during administration of massage. The base cushion 160 preferably if formed from an impervious material such as flexible vinyl plastic or the like—a material that can be configured to define the inflatable chambers 170, 180 and other features of the base cushion as depicted in the drawings.

In operation, the dual cushion support system 100 may be positioned atop a generally horizontal support surface to underlie and support a person 50, 60 in a face-down, chest-down, prone position, as is illustrated in FIGS. 3 and 4, with the upper back and shoulders of the person 50, 60 held elevated, and with the head, neck, arms and lower body portions of the person 50, 60 tilted downwardly to gently stretch and expose the muscles of the neck and back for massage or other treatment.

Suitable cover materials such as a cotton fabric sheets and/or blanket-like materials (not shown) may, of course, be used atop the dual cushion support 100 or to overlie or wrap about the lower-body-support region 126, or about body portions of a person supported by the dual cushion support 100. A cover that includes a conventional electric blanket for applying heat to body portions of a supported person also may be used.

While the invention has been described with a certain degree of particularity, it will be understood that the present disclosure of the preferred embodiment has been made only by way of example, and that numerous changes in the details of construction and the combination and arrangement of elements can be resorted to without departing from the true spirit and scope of the invention as hereinafter claimed. It is intended that the patent shall cover, by suitable expression in the claims, such features of patentable novelty exist in the invention.

What is claimed is:

1. A dual cushion body support for underlying and supporting portions of a person in a prone, face down position for gently stretching, positioning and exposing muscles of the neck and back for administration of treatment such as massage, comprising:

a) upper cushion means for underlying and engaging body portions of a person who lies atop the upper cushion prone, facing downwardly, including a relatively thin and resilient top cushion formed from a single piece of resilient, flexible foamed plastics material of substantially uniform thickness and having an elongate form that has opposed upper and lower ends wherein a rounded upper body support region having arm support formations extending along opposite sides thereof is provided near the upper end, wherein a relatively more narrow lower body support region is provided near the lower end, and with head support means for extending upwardly from the single piece to engage and support forehead portions of the person being connected to the single piece at a location substantially centered between the arm support formations and relatively near the upper end of the single piece; and, b) lower cushion means for underlying and elevating A central part of the upper cushion means to configure the top cushion to elevate and support the chest and shoulders of the person while permitting the head, arms and lower back of the person to tilt downwardly so as to gently stretch, position and expose muscles of the neck and back for massage, including an elongate base cushion having a length significantly less than that of the top cushion and having opposite end regions that define relatively thick chest support means for underlying and significantly elevating the top cushion to raise the chest and shoulders of the persons and abdominal support means that diminishes in thickness as it extends away from the chest support means to progressively diminish the height to which the lower back of the person is elevated by the top cushion, wherein the base cushion includes inflatable interior chamber means for being deflated to render the base cushion more compact for storage and for being adjustably inflated to aid in configuring the base cushion to support the top cushion.

2. The dual cushion support of claim 1 wherein the upper cushion means is sufficiently flexible to enable it to be rolled up for compact storage.

3. The dual cushion support of claim 1 wherein the upper cushion means is protectively coated to facilitate its being wiped clean with a damp cloth, and to resist penetration by body oil used during administration of massage.

4. The dual cushion support of claim 1 wherein the inflatable interior chamber means includes a plurality of separately inflatable interior chambers that can be deflated to render the base cushion more compact for storage and that can be individually inflated to aid in configuring the base cushion to support the top cushion.

5. The dual cushion support of claim 4 wherein the plurality of separately inflatable interior chambers includes inflatable primary inflatable chamber means for receiving and releasably retaining compressed gas for configuring a majority of the length of the base cushion to underlie the top cushion to support body portions of the person for massage, and secondary inflatable chamber means for being selectively inflated and deflated to selectively increase and diminish the inflated length of the base cushion to support the head and shoulders of persons of tall and short stature.

6. The dual cushion support of claim 1 wherein the top cushion includes a facial opening means formed through a central area of the upper body support region near the head support means for preventing contact of the top cushion with facial portions of the person.

7. The dual cushion support of claim 6 wherein the head support means includes a raised, resilient, pillow shaped formation located adjacent the facial opening means.

8. A dual cushion body support for underlying and supporting portions of a person in a prone, face down position for gently stretching, positioning and exposing muscles of the neck and back for administration of treatment such as massage, comprising:

a) flexible, elongate, upper cushion means for underlying and engaging body portions of a person who lies atop the upper cushion prone, facing downwardly, and for being rolled up for compact storage, including a relatively thin and resilient top cushion formed from a single piece of resilient, flexible foamed plastics material of substantially uniform thickness and having an elongate form that has opposed upper and lower ends wherein a rounded upper body support region having area support formations extending along opposite sides thereof is provided near the upper end, wherein a relatively more narrow lower body support region is provided near the lower end, with head support means for extending upwardly from the single piece to engage and support forehead portions of the person being connected to the single piece at a location substantially centered between the arm support formations and relatively near the upper end of the single piece, with the head support means including a raised, resilient, pillow shaped formation, and with the top cushion and head support means being protectively coated to facilitate being wiped clean with a damp cloth and to resist penetration by body oil used during administration of massage; and, b) lower cushion means for underlying and elevating a central part of the upper cushion means to configure the top cushion to elevate and support the chest and shoulders of the person while permitting the head, arms and lower back of the person to tilt downwardly so as to gently stretch, position and expose muscles of the neck and back for massage, including an elongate base cushion having a length significantly less than that of the top cushion and having opposite end regions that define relatively thick chest support means for underlying and significantly elevating the top cushion to raise the chest and shoulders of the person, and abdominal support means that diminishes in thickness as it extends away from the chest support means to progressively diminish the height to which the lower back of the person is elevated by the top cushion, wherein the base cushion includes inflatable interior chamber means for being deflated to render the base cushion more compact for storage and for being adjustably inflated to aid in configuring the base cushion to support the top cushion, and wherein the inflatable interior chamber means includes a plurality of separately inflatable interior chambers that can be deflated to render the base cushion more compact for storage and that can be individually inflated to aid in configuring the base cushion to support the top cushion.

9. The dual cushion support of claim 8 wherein the plurality of separately inflatable interior chambers includes inflatable primary inflatable chamber means for receiving and releasably retaining compressed gas for configuring a majority of the length of the base cushion to underlie the top cushion to support body portions of the person for massage, and secondary inflatable chamber means for being selectively inflated and deflated to selectively increase and diminish the inflated length of the base cushion to support the head and shoulders of persons of tall and short stature.

10. The dual cushion support of claim 8 wherein the top cushion includes a facial opening means formed through a central area of the upper body support region near the head support means for preventing contact of the top cushion with facial portions of the person.

* * * * *